US005215673A

United States Patent [19]

Beacom

[11] Patent Number: 5,215,673

[45] Date of Patent: Jun. 1, 1993

[54] APPARATUS FOR THE PRODUCTION OF A SYMMETRICAL OVAL CONCRETE PIPE

[76] Inventor: Roger Beacom, 241 Sorrento Ranches Dr., Nokomis, Sarasota County, Fla. 34275

[21] Appl. No.: 829,379

[22] Filed: Feb. 3, 1992

[51] Int. Cl.[5] ..... B28B 7/28; B28B 21/76

[52] U.S. Cl. ..... 249/100; 249/144; 249/146; 249/161; 249/169; 249/177; 425/182; 425/432; 425/456

[58] Field of Search ..... 264/333; 425/182, 432, 425/456; 249/144, 146, 161, 168, 169, 177, 100

[56] References Cited

U.S. PATENT DOCUMENTS

| | | | |
|---|---|---|---|
| 2,311,358 | 2/1943 | Baily | 264/69 |
| 2,321,277 | 6/1943 | Boyle | 264/72 |
| 2,376,414 | 5/1945 | Billner et al. | 264/333 |
| 2,990,600 | 7/1961 | Tyra | 249/100 |
| 3,139,469 | 6/1964 | Miller | 264/333 |
| 3,273,216 | 9/1966 | Gourlie | 264/71 X |
| 3,276,091 | 10/1966 | Pausch | 249/100 |
| 3,530,553 | 9/1970 | Engle et al. | 249/100 |
| 3,584,356 | 6/1971 | Joelson . | |
| 3,922,133 | 11/1975 | Crawford et al. | 249/100 X |
| 3,945,787 | 3/1976 | Walchek | 249/100 X |
| 4,039,642 | 8/1977 | Steiro | 264/71 |
| 4,123,033 | 10/1978 | Joelson | 249/100 X |
| 4,134,568 | 1/1979 | Christian | 249/100 X |
| 4,427,619 | 1/1984 | Peterson | 264/333 |
| 4,449,912 | 5/1984 | Ogura | 249/100 X |
| 4,565,381 | 1/1986 | Joelson | 277/208 X |
| 4,686,756 | 8/1987 | Joelson | 29/525 X |
| 4,756,861 | 7/1988 | Schultz | 264/71 |
| 4,798,698 | 1/1989 | Joelson | 264/333 X |
| 4,957,424 | 9/1990 | Mitchell et al. | 425/456 X |
| 5,040,968 | 8/1991 | Kraiss | 264/333 X |

FOREIGN PATENT DOCUMENTS

| | | | |
|---|---|---|---|
| 89420 | 9/1983 | European Pat. Off. | 264/71 |
| 1226474 | 10/1966 | Fed. Rep. of Germany | 249/100 |
| 2549721 | 5/1977 | Fed. Rep. of Germany | 249/100 |
| 2607692 | 9/1977 | Fed. Rep. of Germany | 249/100 |

*Primary Examiner*—Karen Aftergut
*Attorney, Agent, or Firm*—A. W. Fisher, III

[57] ABSTRACT

An apparatus for the production of a symmetrical oval concrete pipe including an oval male joint member and an oval female joint member formed on opposite ends of an oval pipe body having a form including an outer jacket and an inner core disposed in spaced relationship relative to each other to form the oval pipe body therebetween; an upper pallet and a lower pallet configured to form the oval male joint member and the oval female joint member respectively, and a pallet positioning structure configured to engage the upper pallet and the lower pallet to operatively position the upper pallet and lower pallet relative to the outer jacket and inner core such that corresponding points on the upper pallet and the lower pallet are aligned relative to each other whereby corresponding points of the oval male joint member and the female joint member are aligned relative to each other.

4 Claims, 7 Drawing Sheets

APPARATUS FOR THE PRODUCTION OF A SYMMETRICAL OVAL CONCRETE PIPE

BACKGROUND OF THE INVENTION

1. Field of the Invention

A method and apparatus for the fabrication or production of a longitudinally symmetrical oval concrete pipe.

2. Description of the Prior Art

Typically, round pipes used to carry or transport large volumes of water or other fluid include an enlarged circular bell end to receive the circular spigot of the next adjacent round pipe. However the terrain and water table in some areas does not permit use of round pipes with enlarged bell joints for sufficient volumes of water or other fluid to be transported. Thus oval pipes have been developed.

Commonly concrete pipes are manufactured in a vertical position employing a vibrating pipe manufacturing machine in which the inner and outer pipe forming members are removed from the pipe while the pipe is still in the machine in a vertical upright position.

Such vibration machines comprise a bottom pallet to form the bottom of the pipe as a groove or tongue, an outerform or jacket, that is positioned on the bottom pallet to form the outside of the pipe, an inner form or core positioned concentrically within the jacket to form the inside of the pipe and a top pallet positioned on top of the pipe to form a groove or a tongue.

In such vibrating machines the jacket, bottom pallet and core form a mold. A no-slump concrete mix is poured into the annular space formed between the jacket and core and compacted by vibration. After the vibrating mold is filled to a predetermined height, a top pallet is placed in pressure contact with the concrete mix in the top of the mold.

U.S. Pat. No. 3,584,356 discloses such an apparatus for forming hollow reinforced concrete at a pouring station including a bottom pallet, a pallet saddle, an outer jacket, a core mounted concentrically within and spaced from the outer jacket, means to feed concrete into the space between the core and the jacket and a top pallet holding header. Vibrators are provided on the jacket, core and header to vibrate the concrete as the mold is filled. The bottom ends of the jacket and core cooperate with sealing means incorporated in the pallet saddle to seal the bottom of the mold. More specifically, the invention includes initially lowering the jacket onto the bottom pallet, inserting and securing the top pallet to the top pallet holding header, lowering the core through the top pallet and onto the bottom pallet to complete a liquid-tight mold with the top pallet positioned ready to form the top end of the pipe. Concrete mix is poured into the mold on opposite sides of the core eliminating the need for rotating the mold while feeding the mix from a fixed point or using a rotating distributor on a non-rotating mold or some other equally complicated device. The jacket and core are vibrated simultaneously while the concrete mix is poured into the mold and additional vibration is applied to the top pallet holding header to form the top end of the pipe with the top pallet. The top pallet is released from the top pallet holding header and raised slightly. The core and jacket are stripped upwardly and the top pallet remains with the completed pipe ready to be removed from the machine.

Unfortunately alignment and fitting oval concrete pipes with such an apparatus is relatively difficult due to nonalignment of the male and female joint members formed on opposite ends of each oval concrete pipe.

SUMMARY OF THE INVENTION

The present invention relates to an apparatus for the production of a symmetrical oval concrete pipe including an oval male joint member and an oval female joint member formed on opposite ends of an oval pipe body comprising a form including an outer jacket and an inner core disposed in spaced relationship relative to each other to form the oval pipe body therebetween; an upper pallet and a lower pallet configured to form the oval male joint member and the oval female joint member respectively.

A pallet positioning means is configured to engage the upper pallet and the lower pallet to operatively position the upper pallet and lower pallet relative to each other and to the outer jacket and inner core such that corresponding points on the upper pallet and the lower pallet are aligned relative to each other whereby corresponding points of the oval male joint member and the female joint member are aligned relative to each other.

Specifically the pallet positioning means comprises an upper pallet positioning section and a lower pallet positioning section. The upper pallet positioning section comprises a pair of upper pallet positioning means each comprising a first upper pallet positioning element formed on the outer jacket and a second upper pallet positioning element formed on the upper pallet. Each first upper pallet positioning element comprises a positioning member including a radial alignment means and a lateral alignment means on the upper portion thereof. Each second upper pallet positioning means comprises a notch. The lower pallet positioning section comprises a pair of lower pallet positioning means each comprising a first lower pallet positioning element formed on the outer jacket and a second lower pallet positioning element formed on the lower pallet. Each first lower pallet positioning element comprises a positioning member including a radial alignment means and a lateral alignment means formed on the lower portion thereof. Each second lower pallet positioning means comprises a notch.

In use, the operator first places the lower pallet on a lower pallet saddle. A reinforcement wire cage is then positioned on the lower pallet. The outer jacket is moved downwardly such that each first lower pallet positioning means engages the corresponding second lower pallet positioning means to operatively position the outer jacket relative to the lower pallet. The inner core is lowered onto the lower pallet or the pallet could be lowered over the core.

A concrete distributor is positioned to feed concrete to the mold between the inner core and outer jacket. The mold is vibrated to evenly settle the concrete therein. When the mold is filled to the proper height, the upper pallet secured to an upper pallet holding header is moved downwardly onto the concrete mass such that each first upper pallet positioning means engages the corresponding second upper positioning means to operatively align the upper pallet relative to the lower pallet, inner core and outer jacket to form the oval male joint member. Once the oval male joint member is formed, the top pallet holding header releases the upper pallet moving upwardly to release the pressure.

Once the oval concrete pipe is manufactured, the inner core and outer jacket are stripped therefrom and after curing the pallets are removed.

The invention accordingly comprises the features of construction, combination of elements, and arrangement of parts which will be exemplified in the construction hereinafter set forth, and the scope of the invention will be indicated in the claims. dr

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
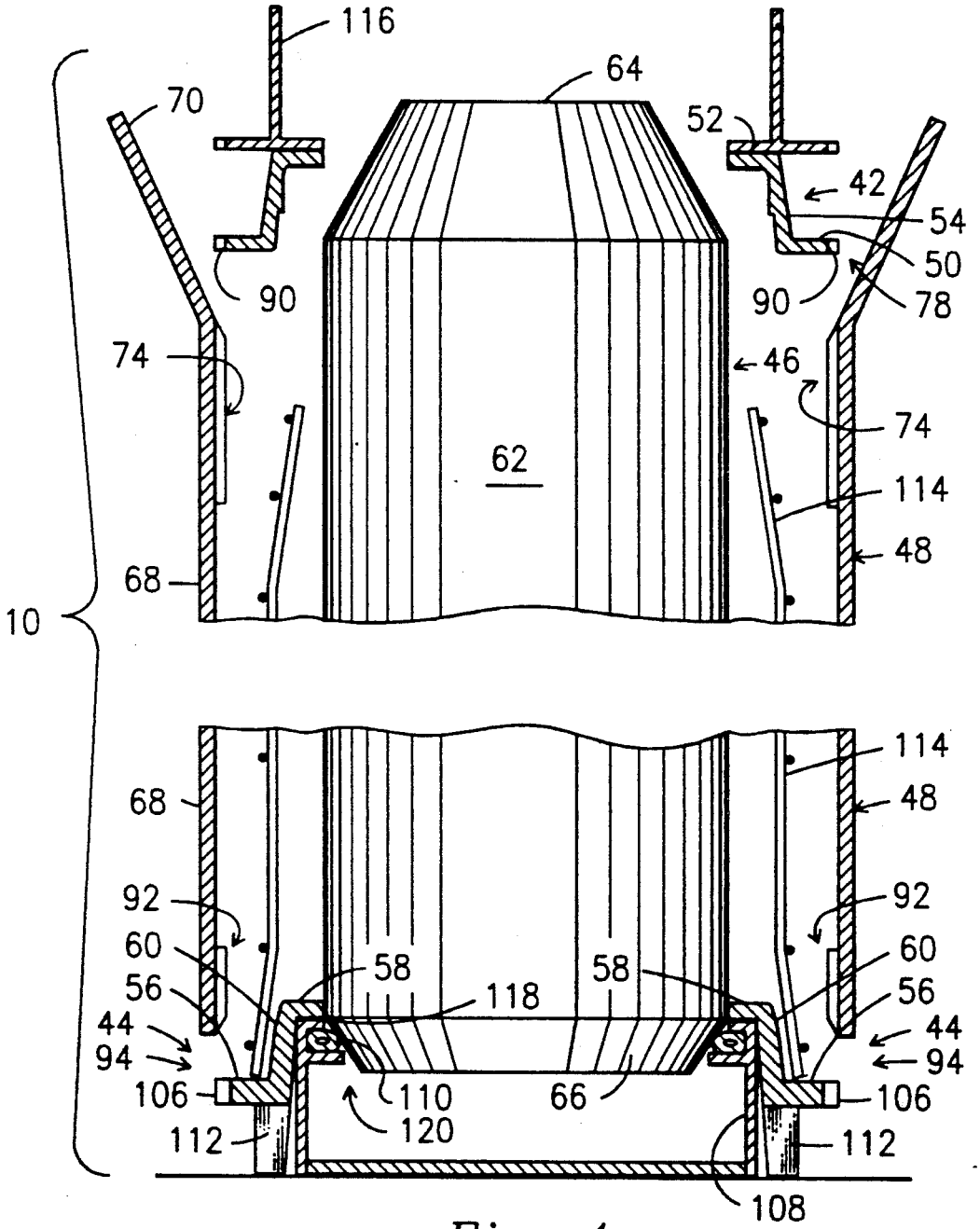
FIG. 1 is a cross-sectional front view of the apparatus of the present invention.
Figure 2:
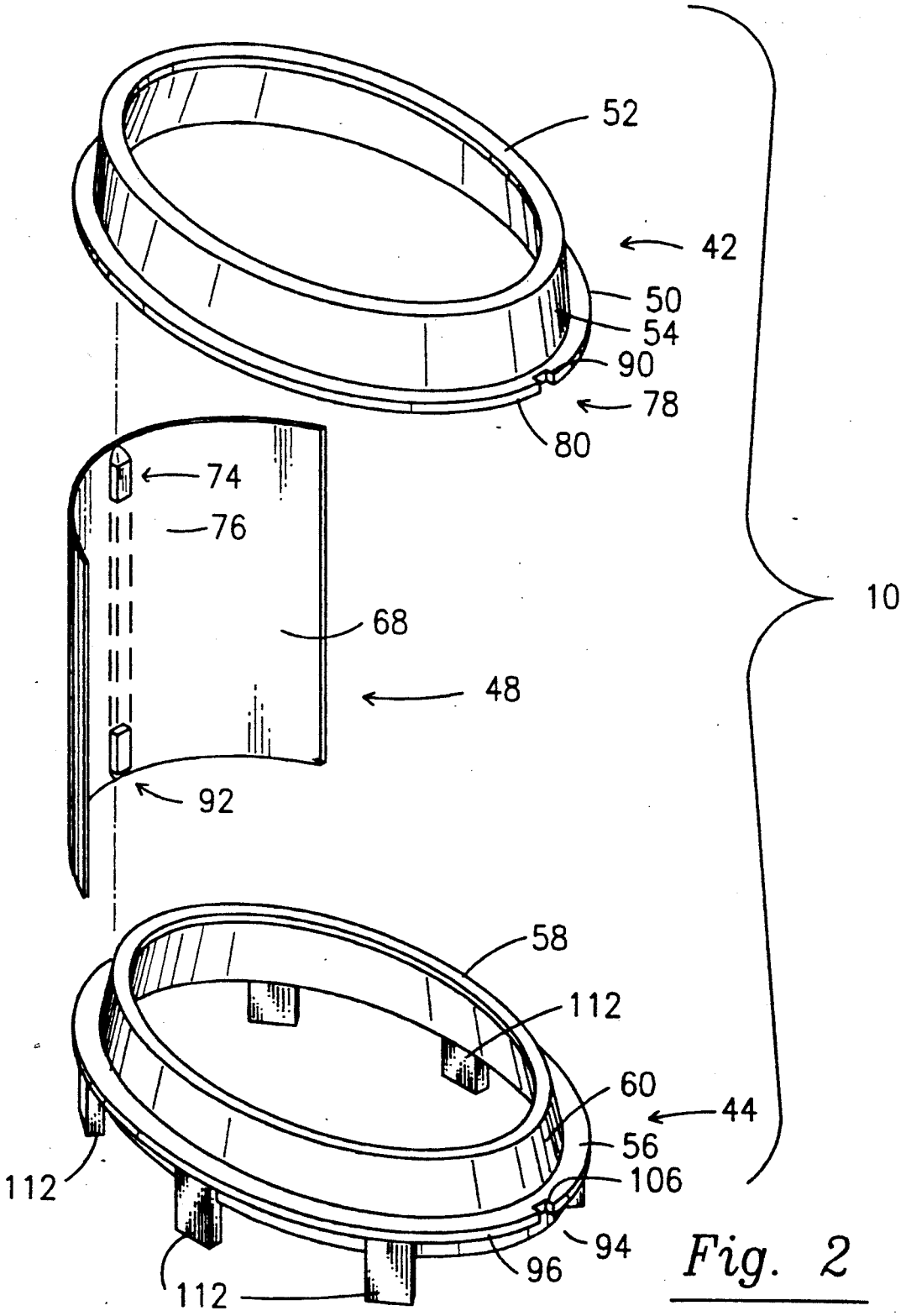
FIG. 2 is a partial exploded perspective view of the apparatus of the present invention.
Figure 3:
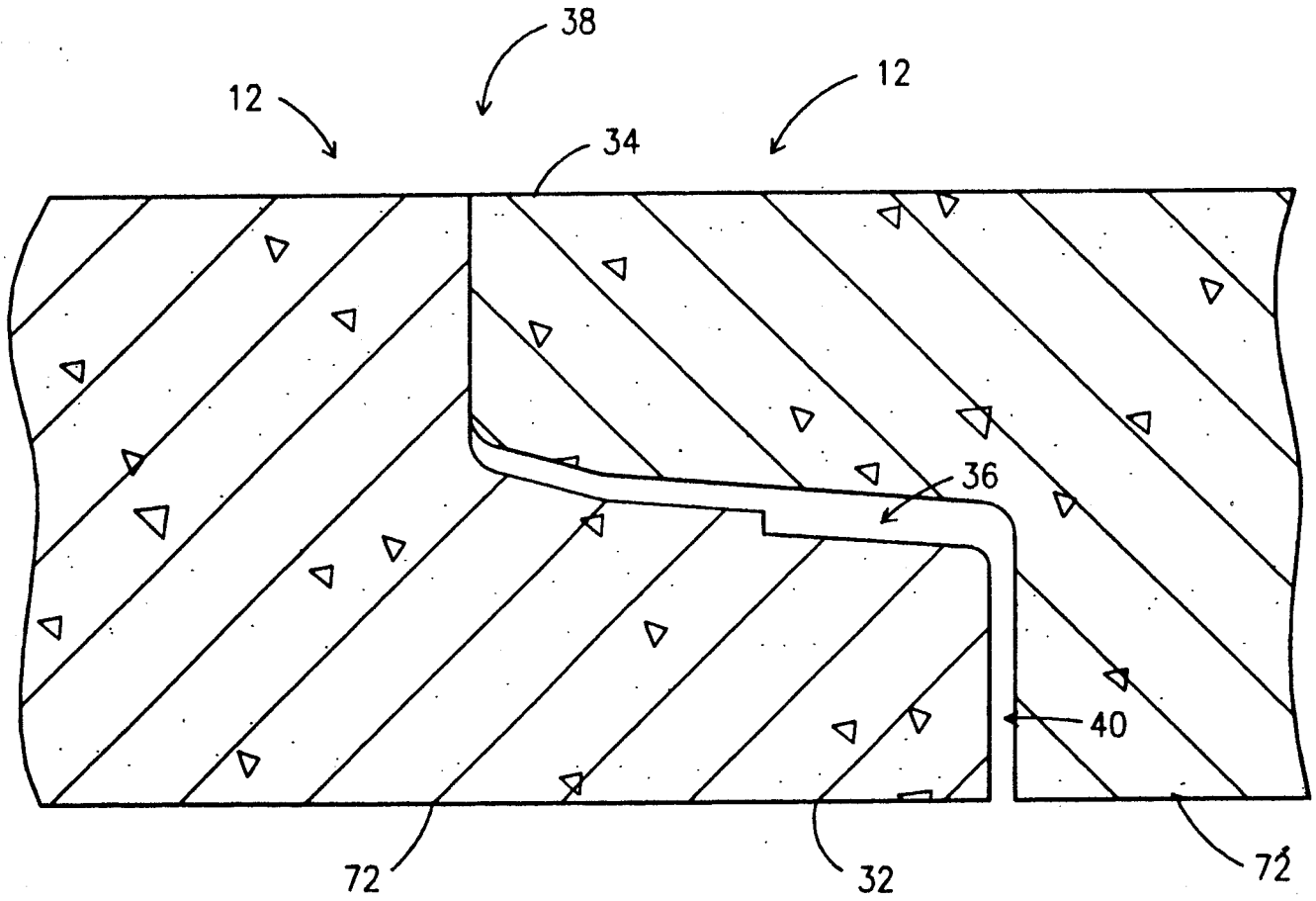
FIG. 3 is a partial detailed cross-sectional side view of the joint formed between adjacent oval concrete pipes of the present invention.

As shown in FIGS. 1 and 2, the present invention relates to an apparatus comprising a mold generally indicated as 10 for the fabrication or production of symmetrical oval concrete pipes each generally indicated as 12 in FIG. 3.

Initially, round pipes used to carry or transport large volumes of water or other fluid included an enlarged circular bell end to receive the circular spigot of the next adjacent round pipe. However the terrain and water table in some areas does not permit use of round pipes with enlarged bell joints for sufficient volumes of water or other fluid to be transported. Thus oval pipes have been developed. Unfortunately alignment and fitting of such oval pipes is relatively difficult due to nonalignment of the male and female joint member formed on opposite ends of each oval pipe unlike round pipe that has no top or bottom.

Figure 4:
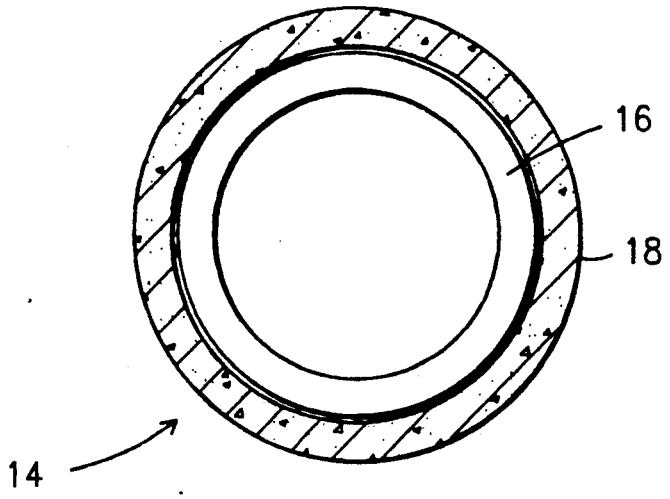
Fig. 4 PRIOR ART
FIG. 4 is a partial cross-sectional end view of a round concrete pipe with the circular male and female joint members of the prior art.

As shown in FIG. 4, the rotational orientation of adjacent round pipes in a pipe line 14 is of no importance since both the spigot 16 and the bell 18 of the next adjacent pipe are circular. Thus radial alignment of the upper and lower pallets (not shown) when forming the round pipes does not affect the subsequent pipe line 14 alignment.

Figure 5:
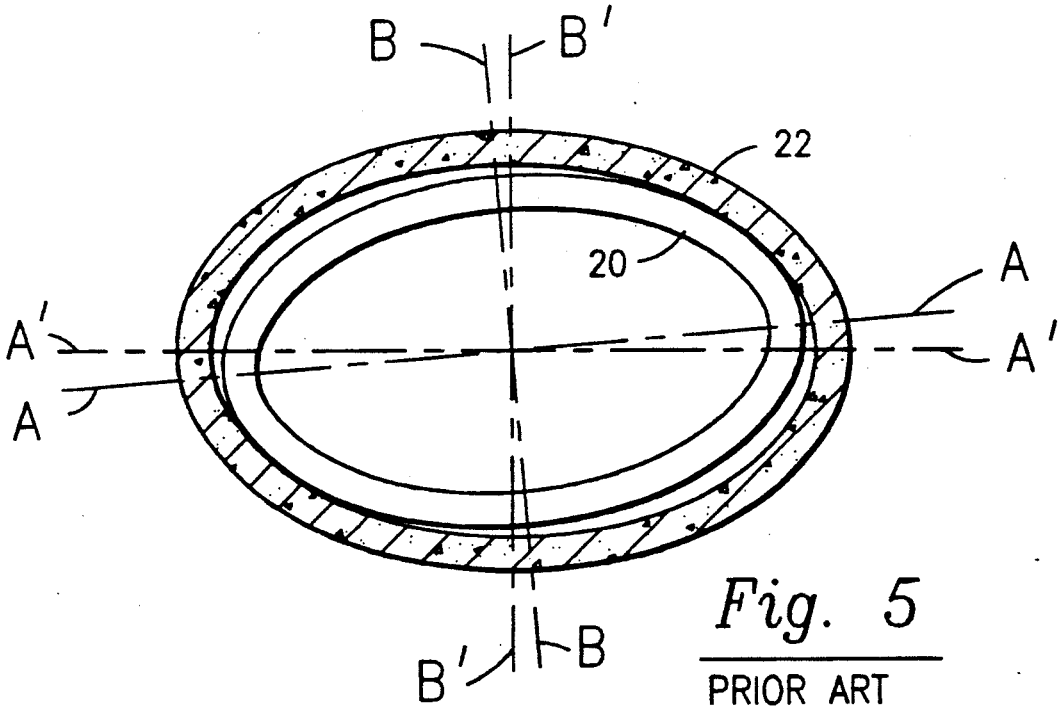
Fig. 5 PRIOR ART
FIG. 5 is a partial cross-sectional end view of an oval concrete pipe with the elliptical male and female joint members of the prior art.
Figure 6:
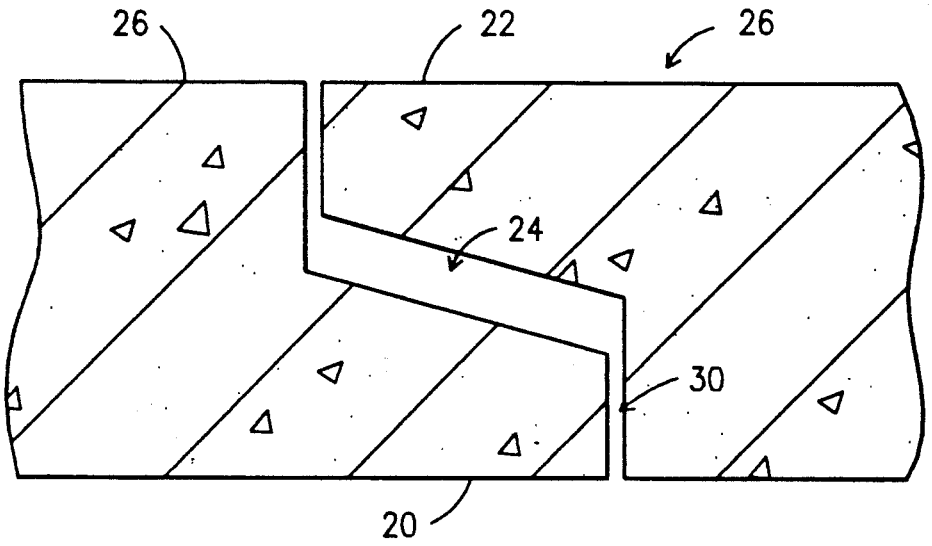
Fig. 6 PRIOR ART
FIG. 6 is a partial detailed cross-sectional side view of the joint formed between adjacent oval concrete pipes of the prior art.
Figure 7:
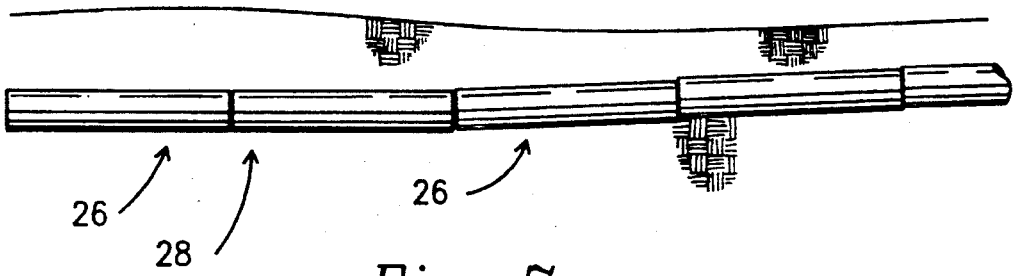
Fig. 7 PRIOR ART
FIG. 7 is a side view of a partial pipe line of oval concrete pipes of the prior art.
Figure 9:
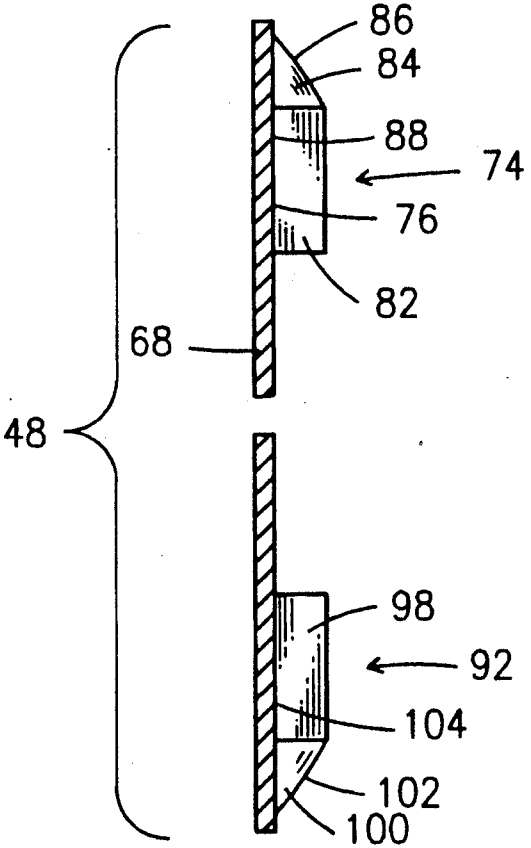
FIG. 9 is a partial cross-sectional side view of the positioning means of the present invention taken along line 9—9 of FIG. 8.
Figure 8:
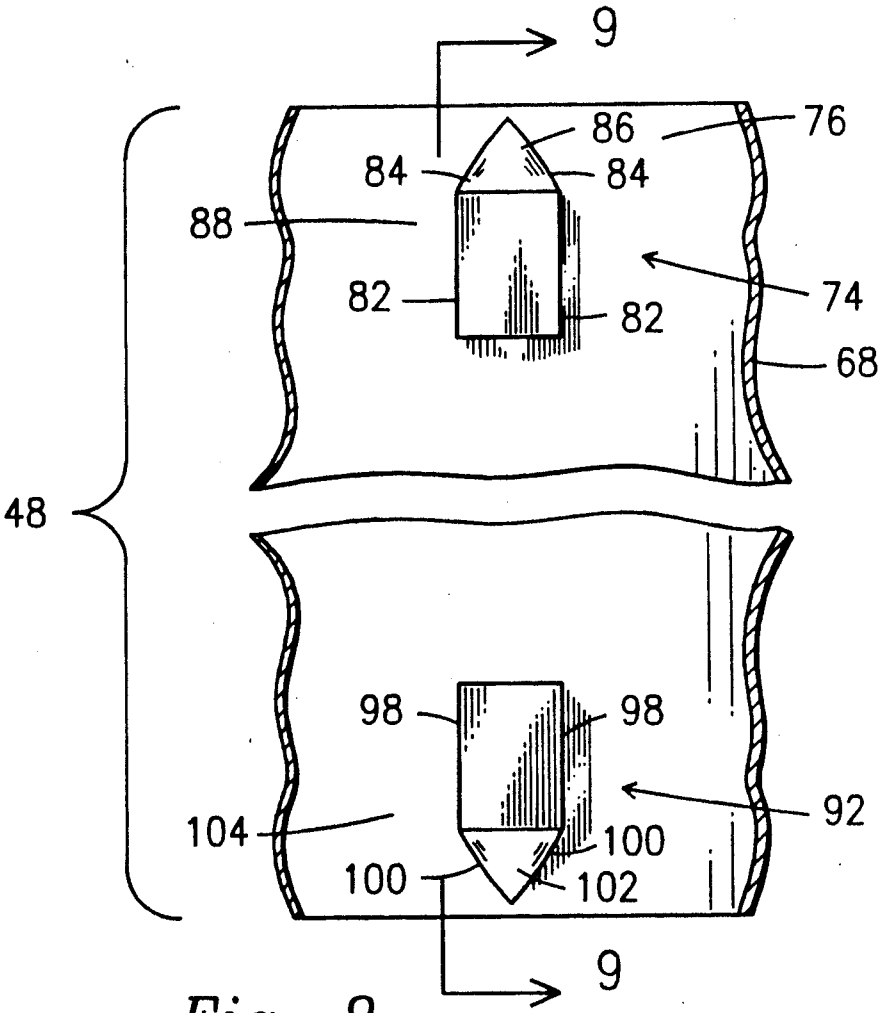
FIG. 8 is a partial front view of the positioning means of the present invention.

In contrast, proper alignment of the male and female joint members formed on opposite ends of oval concrete pipes is particularly important. Specifically, as shown in FIG. 5, if the upper and lower pallets are not properly aligned when forming the oval concrete pipe 12, corresponding points on the substantially elliptical male joint member 20 are generally not aligned with corresponding points on the substantially elliptical female joint member 22 illustrated as lines A/A' and B/B'. To accommodate for the irregular alignment of the substantially elliptical male joint member 20 and the substantially elliptical female joint member 22, the elliptical space 24 formed therebetween when forming a pipe line must be sufficiently larger as shown in FIG. 6 to permit rotational disposition of adjacent oval concrete pipes each generally indicated as 26 when forming a pipe line generally indicated as 28 in FIG. 7. This relatively large elliptical space 24 creates inherent difficulties in sealing the joint 30 formed between the substantially elliptical male joint member 20 and the substantially elliptical female joint member 22 of adjacent oval concrete pipe 12. Moreover as shown in FIG. 7, when adjacent oval concrete pipes 26 are aligned relative to each other to form the pipe line 28 the oval concrete pipes 26 are not axially aligned resulting in an irregular pipe line 28 that is not level further increasing the likelihood of pipe line leakage.

In contrast, as shown in FIG. 3, the apparatus of the present invention is configured to produce or fabricate oval concrete pipes 12 wherein corresponding points of the substantially elliptical male joint member 32 and substantially elliptical female joint member 34 of each oval concrete pipe 12 are axially aligned relative to each other to permit reduction of the elliptical space 36 formed between adjacent oval concrete pipe 12 when forming a pipe line 38 to allow for an enhanced sealing of the joint 40 formed therebetween with the use of various sealing means (not shown).

Specifically, as best shown in FIGS. 1 and 2, the mold 10 of the instant invention comprises an upper pallet, lower pallet, inner core and outer jacket generally indicated as 42, 44, 46 and 48 respectively in combination with a pallet positioning means as described more fully hereinafter.

As shown in FIGS. 1 and 2, the upper pallet 42 comprises a flat substantially elliptical inner base plate 50 and a flat substantially elliptical outer end plate 52 held in spaced relationship relative to each other by an inclined substantially elliptical upper pallet forming member 54 configured to cooperatively form the substantially elliptical male joint member 32.

As shown in FIGS. 1 and 2, the lower pallet 44 comprises a flat substantially elliptical outer end plate 56 and a flat substantially elliptical inner base plate 58 held in spaced relationship to each other by an inclined substantially elliptical lower pallet forming member 60 configured to cooperatively form the substantially elliptical female joint member 34.

As shown in FIGS. 1 and 2, the inner core 46 comprises a substantially elliptical body or form 62 having an upper and lower conical tapered end portion indicated as 64 and 66 respectively and the outer jacket 48 comprises a substantially elliptical hollow shell 68 having a funnel 70 formed on the upper end thereof to cooperatively form a substantially elliptical pipe body 72 of the oval concrete pipe 12.

The pallet positioning means comprises an upper pallet positioning section and a lower pallet positioning section to operatively position the upper pallet 42 and lower pallet 44 relative to each other, and relative to the inner core 46 and outer jacket 48.

As shown in FIGS. 1, 2, 8 and 9, the upper pallet positioning section comprises a pair of upper pallet positioning means each comprising a first upper pallet positioning element generally indicated as 74 formed on the interior wall 76 of the substantially elliptical hollow shell 68 of the outer jacket 48 and a second upper pallet positioning element generally indicated as 78 formed on the periphery 80 of the flat substantially elliptical inner base plate 50 of the upper pallet 42. Each first upper pallet positioning element 74 comprises a substantially vertical rectangular positioning member or key 82 including a pair of radial alignment means or cam surfaces each indicated as 84 and a lateral alignment means or cam surface 86 formed on the upper portion 88 thereof. Each second upper pallet positioning means 78 comprises a substantially rectilinear notch or keyway 90.

As shown in FIGS. 1, 2, 8 and 9, the lower pallet positioning section comprises a pair of lower pallet positioning means each comprising a first lower pallet positioning element generally indicated as 92 formed on the interior wall 76 of the substantially elliptical hollow shell 68 of the outer jacket 48 and a second lower pallet positioning element generally indicated as 94 formed on the periphery 96 of the flat substantially elliptical outer end plate 56 of the lower pallet 44. Each first lower pallet positioning element 92 comprises a substantially vertical rectangular positioning member or key 98 including a pair of radial alignment means or cam surfaces each indicated as 100 and a lateral alignment means or cam surface 102 formed on the lower portion 104 thereof. Each second lower pallet positioning means 94 comprises a substantially rectilinear notch or keyway 106.

Figure 10:
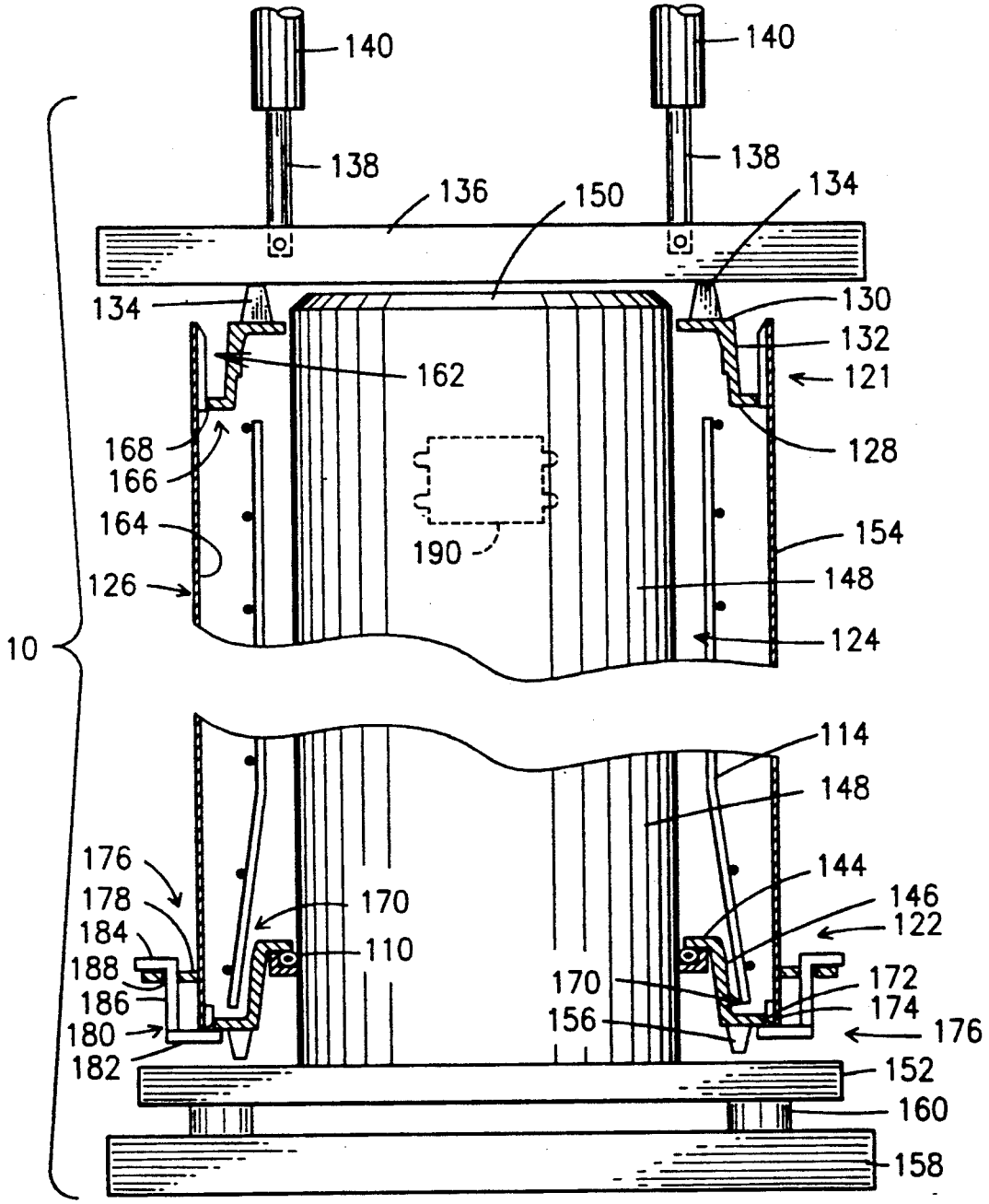
FIG. 10 is a cross-sectional front view of an alternate embodiment of the present invention.

FIG. 10 shows an alternate embodiment of the mold 10 of the instant invention comprising an upper pallet, lower pallet, inner core and outer jacket generally indicated as 121, 122, 124 and 126 respectively in combination with a pallet positioning means as described more fully hereinafter.

The upper pallet 121 comprises a flat substantially elliptical inner base plate 128 and a flat substantially elliptical outer end plate 130 held in spaced relationship relative to each other by an inclined substantially elliptical upper pallet forming member 132 configured to cooperatively form the substantially elliptical male joint member 32. A plurality of lugs or spaces, each indicated as 134 are formed on the flat substantially elliptical outer end plate 130 to engage the press head 136 upon the downward movement of piston 138 relative to the corresponding cylinder 140.

As shown in FIG. 10, the lower pallet 122 comprises a flat substantially elliptical outer end plate 142 and a flat substantially elliptical inner base plate 144 held in spaced relationship to each other by an inclined substantially elliptical lower pallet forming member 146 configured to cooperatively form the substantially elliptical female joint member 34.

The inner core 124 comprises a substantially elliptical body or form 148 having an upper conical tapered end portion 150 and lower core base 152 and the outer jacket 126 comprises a substantially elliptical hollow shell 154 to cooperatively form a substantially elliptical pipe body 72 of the oval concrete pipe 12. The lower pallet 122 includes a plurality of legs each indicated as 156 to support the lower pallet 122 above the lower core base 152 which is in turn supported on the machine base 158 by a plurality of rubber pads each indicated as 160.

The pallet positioning means comprising an upper pallet positioning section and a lower pallet positioning section to operatively position the upper pallet 121 and lower pallet 122 relative to each other, and relative to the inner core 124 and outer jacket 126.

The upper pallet positioning section comprises a pair of upper pallet positioning means each comprising a first upper pallet positioning element generally indicated as 162 formed on the interior wall 164 of the substantially elliptical hollow shell 154 of the outer jacket 126 and a second upper pallet positioning element generally indicated as 166 formed on the periphery 168 of the flat substantially elliptical inner base plate 128 of the upper pallet 121 similar to those shown in FIGS. 1, 2, 8 and 9.

The lower pallet positioning section comprises a pair of lower pallet positioning means each comprising a first lower pallet positioning element generally indicated as 170 formed on the interior wall 164 of the substantially elliptical hollow shell 154 of the outer jacket 126 and a second lower pallet positioning element generally indicated as 172 formed on the periphery 174 of the flat substantially elliptical inner base plate 14 of the lower pallet 122 similar to those shown in FIGS. 1, 2, 8 and 9.

The mold 10 further includes an outer jacket securing means generally indicated as 176 to secure the outer jacket 126 to the lower pallet 122. The outer jacket securing means 176 comprises a mounting plate 178 extending outwardly from the outer jacket 126 and a rotatable securing member generally indicated as 180 including a lower securing plate 182 to engage the lower surface of the flat substantially elliptical outer end plate 142 and a handle 184 interconnected by an interconnecting element 186 possessing an aperture 188 formed through the mounting plate 178.

The method of production of the oval concrete pipe 12 of the present invention is similar to that described in U.S. Pat. No. 3,584,356. Specifically, the operator first places the lower pallet 44 on a lower pallet saddle 108. A first elastic sealing ring 110 on the lower pallet saddle 108 holds the lower pallet legs 112 slightly above the floor. A reinforcement wire cage 114 is then positioned on the lower pallet 44. The outer jacket 48 is moved downwardly such that each first lower pallet positioning means 92 engages the corresponding second lower pallet positioning means 94 to operatively position the outer jacket 48 relative to the lower pallet 44. At this time the lower pallet legs 112 are in contact with the floor. An upper pallet holding header 116 supports the upper pallet 42 for proper positioning as described hereinafter.

The inner core 62 is lowered onto the lower pallet saddle 108 to form a liquid-tight mold with the first elastic sealing ring 110. The lower conical tapered end portion 66 engages the inner surface 118 of the elliptical centrally disposed aperture 120 formed in the flat substantially elliptical inner base plate 58 to align the inner core 46 relative to the outer jacket 48 and lower pallet 44.

A concrete distributor (not shown) is positioned to feed concrete to the mold 10 between the inner core 46 and outer jacket 48. The mold 10 is vibrated to evenly settle the concrete therein. When the mold 10 is filled to the proper height, the upper pallet 42, secured to the upper pallet holding header 116, is moved downwardly onto the concrete mass such that each first upper pallet positioning means 74 engages the corresponding second upper positioning means 78 to operatively align the upper pallet 42 relative to the lower pallet 44, inner core 46 and outer jacket 48 to form the substantially elliptical male joint member 32. Once the substantially elliptical male joint member 32 is formed, the top pallet holding header 116 releases the upper pallet 42 moving upwardly to release the pressure. Once the oval concrete pipe 12 is manufactured, inner core 46 and outer jacket 48 are stripped therefrom. The cycle is ready to repeat. After the pipe is cured, the top and bottom pallets are removed.

The method of using the embodiment shown in FIG. 10 is similar in operation except that the inner core 124 having a vibrator 190 attached thereto is mounted to the machine base 158.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus for the production of an oval concrete pipe including a substantially elliptical male joint member and a substantially elliptical female joint member formed on opposite ends of an oval pipe body comprising a mold including a substantially elliptical outer jacket having first and second opposite ends and a substantially elliptical inner core disposed in spaced relationship relative to each other to form said oval pipe body therebetween; a substantially elliptical upper pallet and a substantially elliptical lower pallet configured to form said substantially elliptical male joint member and said substantially elliptical lower pallet respectively, and a pallet positioning means to operatively position said substantially elliptical upper pallet and said substantially elliptical lower pallet relative to said substantially elliptical outer jacket, said substantially elliptical inner core and to each other such that corresponding points on said substantially elliptical upper pallet and said substantially elliptical lower pallet are axially and radially aligned relative to each other whereby corresponding points of said substantially elliptical male joint member and said substantially elliptical female joint member are aligned relative to each other, said pallet positioning means comprises an upper pallet positioning section including an upper pallet positioning means comprising a first upper pallet positioning element comprising a substantially rectilinear radial alignment member having at least one cam surface formed on one side thereof and a lateral alignment member having a cam surface formed thereon formed on said substantially elliptical outer jacket at said first opposite end and a second upper pallet positioning element comprising a notch formed on said substantially elliptical upper pallet disposed to operatively engage each other and a lower pallet positioning section including a lower pallet positioning means comprising a first lower pallet positioning element comprising a substantially rectilinear radial alignment member having at least one cam surface formed on one side thereof and a lateral alignment member having a cam surface formed thereon formed on said substantially elliptical outer jacket at said second opposite end and a second lower pallet positioning element comprising a notch formed on said substantially elliptical lower pallet disposed to operatively engage each other to position said substantially elliptical upper pallet and said substantially elliptical lower pallet relative to each other, and relative to said substantially elliptical inner core and said substantially elliptical outer jacket.

2. The apparatus for the production of an oval concrete pipe of claim 1 wherein said radial alignment members include a cam surface formed on each side thereof.

3. The apparatus for the production of an oval concrete pipe of claim 1 wherein said substantially elliptical outer jacket comprises an elliptical hollow shell having said first upper pallet positioning element formed on an upper portion of an interior wall thereof and wherein said substantially elliptical upper pallet includes a flat substantially elliptical inner base plate having said second upper pallet positioning element formed on a thereof and having said first lower pallet positioning element formed on a lower portion of said interior wall thereof of said elliptical hollow shell and wherein said substantially elliptical lower pallet includes a flat substantially elliptical inner base plate having said second lower pallet positioning element formed on a periphery thereof.

4. The apparatus for the production of an oval concrete pipe of claim 1 wherein said upper pallet positioning section comprises a pair of said upper pallet positioning means and said lower pallet positioning section comprises a pair of said lower pallet positioning means.

* * * * *